US010265582B2

(12) United States Patent
Price

(10) Patent No.: US 10,265,582 B2
(45) Date of Patent: Apr. 23, 2019

(54) SUPPORT DEVICE FOR PERFORMING FLOOR EXERCISE

(71) Applicant: Nathan J. Price, West Des Moines, IA (US)

(72) Inventor: Nathan J. Price, West Des Moines, IA (US)

( * ) Notice: Subject to any disclaimer, the term of this patent is extended or adjusted under 35 U.S.C. 154(b) by 471 days.

(21) Appl. No.: 14/219,464

(22) Filed: Mar. 19, 2014

(65) Prior Publication Data

US 2014/0287893 A1 Sep. 25, 2014

Related U.S. Application Data

(60) Provisional application No. 61/803,510, filed on Mar. 20, 2013.

(51) Int. Cl.

| | |
|---|---|
| ***A63B 21/00*** | (2006.01) |
| ***A63B 22/16*** | (2006.01) |
| ***A63B 23/02*** | (2006.01) |
| ***A63B 23/025*** | (2006.01) |
| ***A63B 26/00*** | (2006.01) |

(52) U.S. Cl.

CPC ..... *A63B 26/003* (2013.01); *A63B 21/4039* (2015.10); *A63B 22/16* (2013.01); *A63B 23/025* (2013.01); *A63B 23/0233* (2013.01); *A63B 23/0238* (2013.01)

(58) Field of Classification Search

CPC . A63B 21/00109; A63B 22/16; A63B 23/025; A63B 22/0233; A63B 22/14; A63B 26/003; A63B 21/4047; A63B 23/02–23/0238; A47C 16/00; A47C 16/005; A47G 9/10; A47G 9/1009; A47G 9/1018; A47G 9/1081

USPC ..... 482/10, 79, 80, 131, 132, 139, 140–142, 482/146, 147; 606/240; 5/417, 419, 420; 248/118, 118.1, 118.3, 118.5

See application file for complete search history.

(56) References Cited

U.S. PATENT DOCUMENTS

| | | | | |
|---|---|---|---|---|
| 1,904,039 | A * | 4/1933 | Bruder | 606/240 |
| 4,583,731 | A * | 4/1986 | Crivello | A63B 23/025 482/130 |
| 4,987,625 | A * | 1/1991 | Edelson | 5/657 |
| 5,474,513 | A * | 12/1995 | Carlesimo et al. | 482/140 |
| 5,774,916 | A * | 7/1998 | Kurhi | A61F 5/055 128/845 |
| 5,792,035 | A * | 8/1998 | Ward et al. | 482/140 |
| 5,795,276 | A * | 8/1998 | Almeda | 482/142 |
| 5,833,590 | A * | 11/1998 | Chiu | A63B 21/0552 482/112 |
| 5,888,181 | A * | 3/1999 | Yeh | 482/140 |
| 6,213,923 | B1 * | 4/2001 | Cameron | A63B 21/012 297/50 |
| 6,283,900 | B1 * | 9/2001 | Tornabene | A63B 21/055 482/122 |
| 6,398,699 | B1 * | 6/2002 | Yang | A63B 22/14 482/142 |

(Continued)

*Primary Examiner* — Jennifer M Deichl

(74) *Attorney, Agent, or Firm* — Zarley Law Firm, P.L.C.

(57) ABSTRACT

An exercise support having a base with a top surface, a bottom surface, a first end and a second end. Preferably, the base is curved to form generally an S-shape. Attached to the bottom surface is a support member. A narrowed or head section is formed at the second end of the base. Preferably a pair of handles extend outwardly from the narrowed section for gripping.

10 Claims, 4 Drawing Sheets

(56) References Cited

U.S. PATENT DOCUMENTS

| | | | | |
|---|---|---|---|---|
| 6,971,977 | B1 * | 12/2005 | Chen | A63B 21/0552 297/258.1 |
| 7,137,934 | B2 * | 11/2006 | Paramater | 482/123 |
| 7,451,507 | B2 * | 11/2008 | Brinkerhoff | A61G 13/12 5/637 |
| 7,661,163 | B1 * | 2/2010 | Gallaher | 5/632 |
| 7,951,056 | B2 * | 5/2011 | Radzwill | A63B 21/078 482/142 |
| 9,050,492 | B2 * | 6/2015 | Shifferaw | A63B 21/0421 |
| 2002/0187886 | A1 * | 12/2002 | Wu | 482/142 |
| 2004/0033873 | A1 * | 2/2004 | Van Straaten | 482/142 |
| 2005/0075225 | A1 * | 4/2005 | Shin | A63B 21/0004 482/130 |
| 2008/0058183 | A1 * | 3/2008 | Younane et al. | 482/140 |
| 2009/0011911 | A1 * | 1/2009 | Lee | A63B 6/00 482/142 |
| 2009/0023565 | A1 * | 1/2009 | Liang | 482/142 |
| 2009/0229048 | A1 * | 9/2009 | Maganov | 5/420 |
| 2016/0206910 | A1 * | 7/2016 | Duke | A63B 21/0004 |

* cited by examiner

SUPPORT DEVICE FOR PERFORMING FLOOR EXERCISE

CROSS REFERENCE TO RELATED APPLICATION

This application claims the benefit of U.S. Provisional Application No. 61/803,510 filed Mar. 20, 2013.

BACKGROUND OF THE INVENTION

This invention is directed to an exercise support device and more particularly to an exercise support having safe, comfortable, anatomical contours for maximizing efficacy of ground based exercises for the posterior musculature.

Exercise devices and supports are well known in the art. For ground based body weight exercises, there is currently no way to train the posterior musculature of the body without sacrificing either the efficacy, or safety of the movement. The performance of the front plank, in which a person supports their own body weight with the toes, and forearms as contact points can be easily performed; and is effective in its training of the anterior musculature of the body. There is no way to effectively perform the reverse of this exercise, which will be referred to as the reverse plank, without placing strain on various joints and muscles of the body. Also, the performance of hamstring curls from the ground presents a problem. In proper performance of this exercise the upper back and neck are forced into positions compromising to health and performance. Therefore, there is a need in the art for a device that addresses these deficiencies.

An objective of the present invention is to provide an exercise support that enables individuals to train the posterior musculature.

A further objective is to provide an exercise support that provides contours for maintaining safe and comfortable anatomical exercise positions.

A still further objective of the present invention is to provide an exercise support that maximizes efficacy of ground based exercises of the posterior musculature.

These and other objectives will be apparent to one of ordinary skill in the art based upon the following written description.

SUMMARY OF THE INVENTION

An exercise support having a base with a top surface, a bottom surface, a first end and a second end. Preferably, the base is curved to form generally an S-shape. Attached to the bottom surface is a support member. A narrowed or head section is formed at the second end of the base. Preferably a pair of handles extend outwardly from the narrowed section for gripping.

A pair of ridges are aligned transversely across the top surface of the base and are separated by an open area. A neck support is attached to the narrowed section adjacent the open area.

DETAILED DESCRIPTION OF THE PREFERRED EMBODIMENTS

Figure 1:
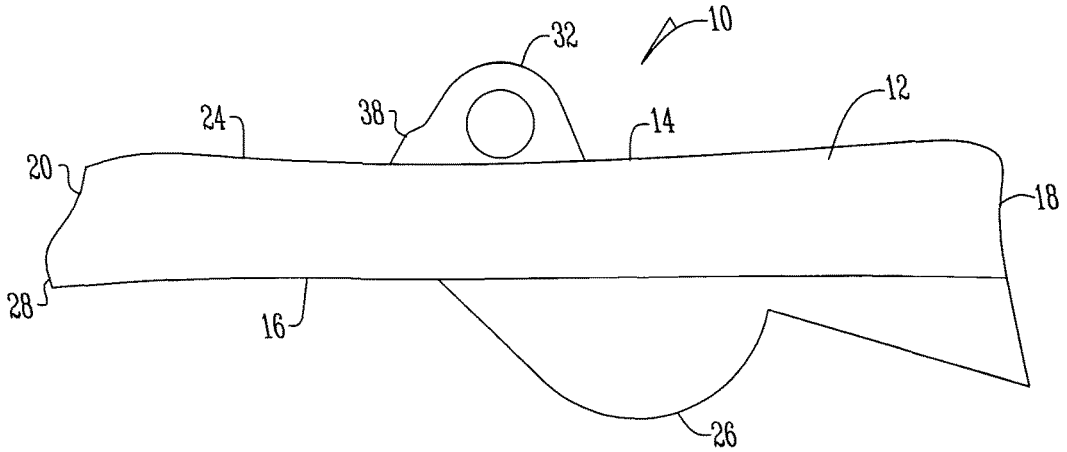
FIG. 1 is a side view of an exercise support.
Figure 2:
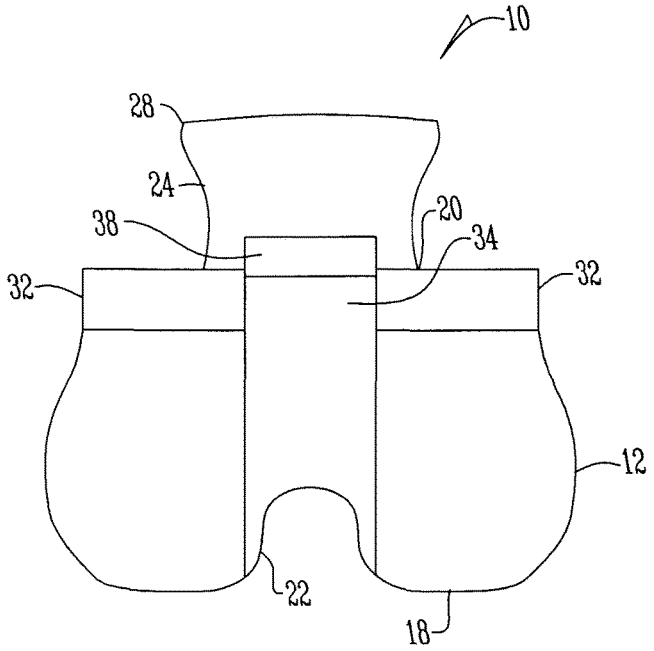
FIG. 2 is a top plan view of an exercise support.
Figure 3:
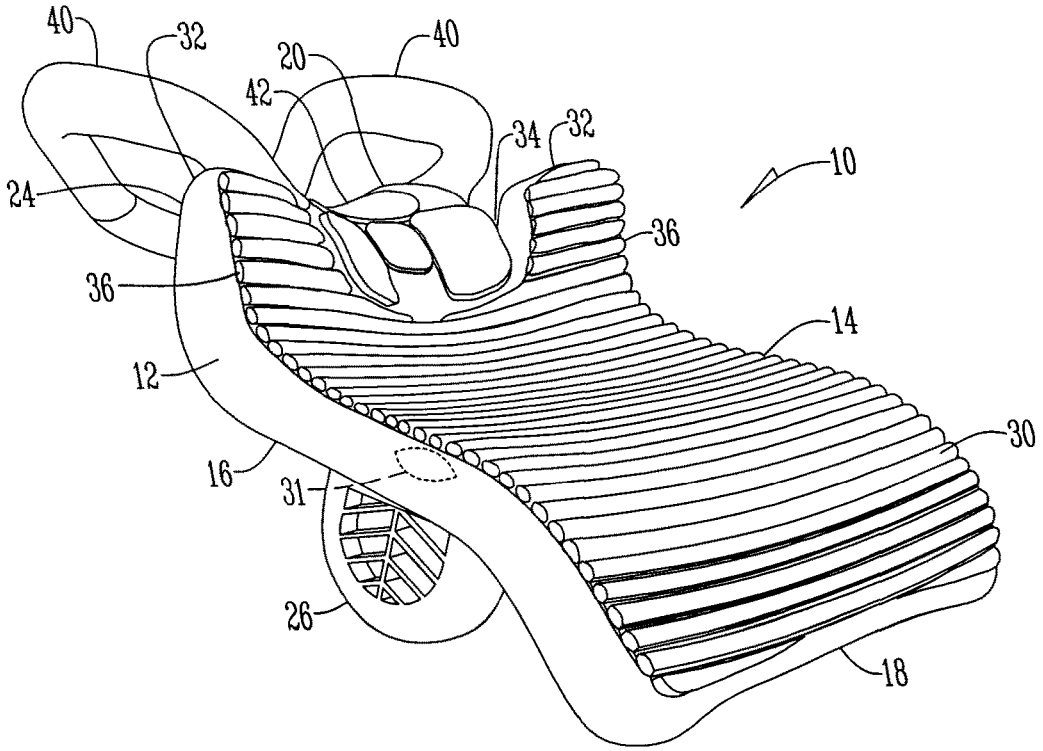
FIG. 3 is a perspective view of an exercise support.
Figure 4:
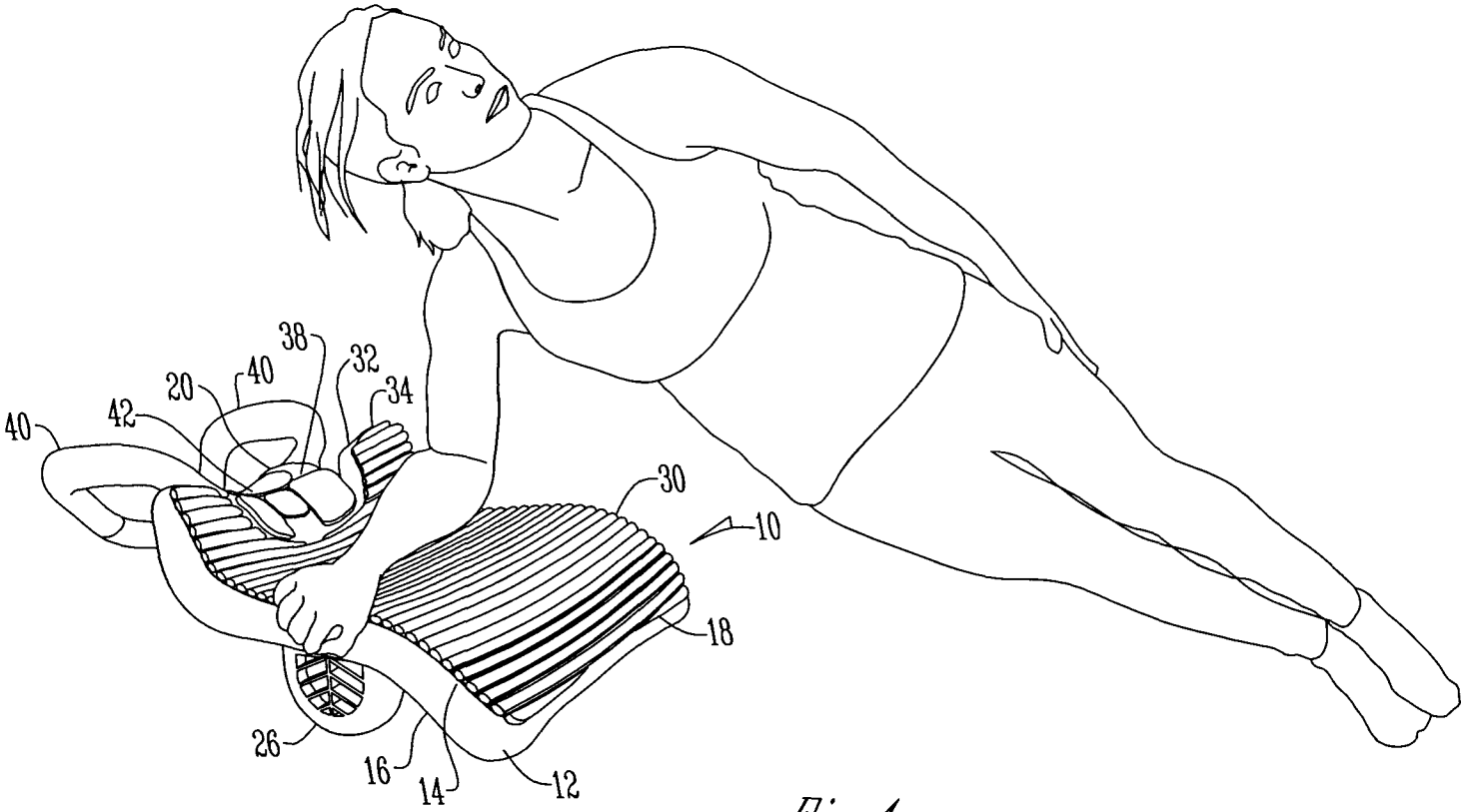
FIG. 4 is a perspective view of an exercise support.
Figure 5:
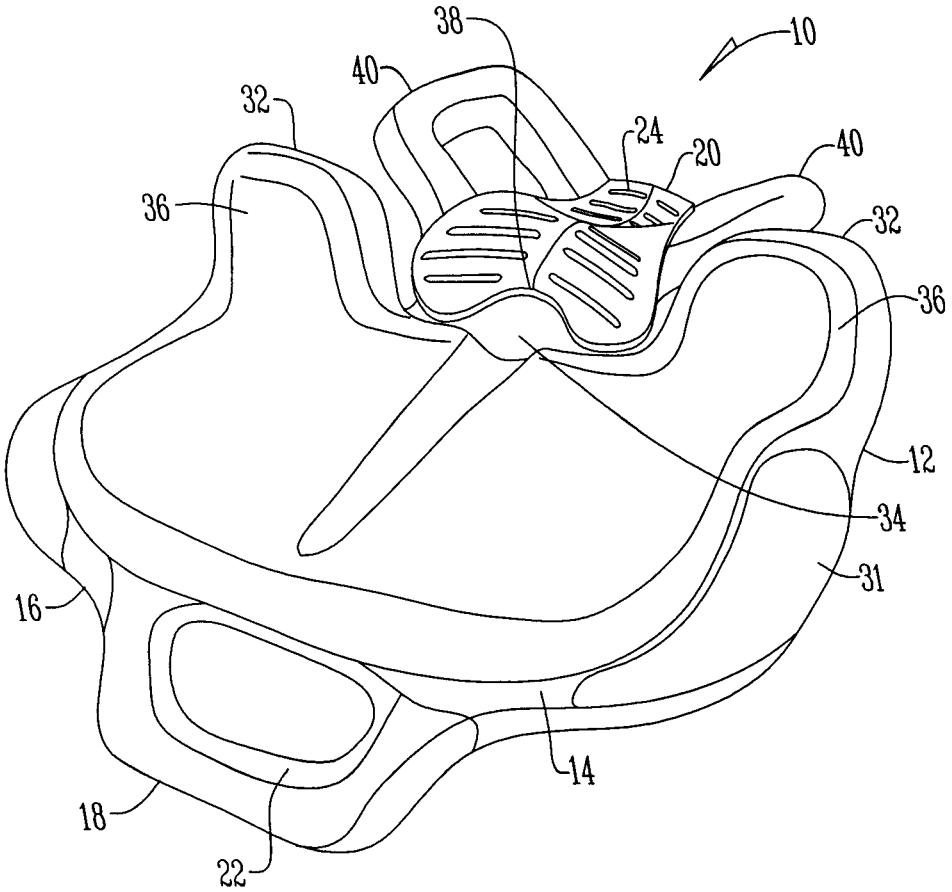
FIG. 5 is a perspective view of an exercise support.

Referring to the Figures, the exercise support 10 has a base 12 having a top surface 14, a bottom surface 16, a first end 18, and a second end 20.

Preferably, the base 12 has cut out section 22 at the first end 18 and narrows in width at the second end 20 to form a section 24 for supporting an individual's head. The head section 24 may have a plurality of vents. Alternatively, the first end 18 is sold or has at least one loop. Connected or molded to the bottom surface of the base 12 is a support member 26 that preferably is partially cylindrical in shape and lays transversely across the base 12 closer to the first end 18 than the second end 20. A flange or ridge 28 extends away from the base 12 at the outer perimeter of the head section 24 to permit an individual to grip the flange 28 during use.

Attached to at least a portion of the top surface 14 is a layer of material 30 that provides comfort for an individual. On the outer periphery of the top surface 14 of the base 12 are gripping sections 31. Also connected or molded to the top surface 14 of the base 12 are a pair of ridges 32. The ridges 32 are aligned transversely across the base 12 and are separated by an open area 34. The ridges 32 are preferably positioned at or near the midpoint between the first end 18 and the second end 20 on the upper back section 36 of the base 12. While the ridges 32 are of any size or shape, preferably they are generally arcuate, taper downwardly at the ends near open area 34, and comprise ⅔ of the width of the upper back section 36.

Connected or molded to the top surface 14 of the head section 24 and adjacent open area 34 is a neck support 38. Preferably, the neck support is arcuate and the apex of the neck support 38 is below the apex of ridges 32.

Alternatively, extending outwardly from section 24 are a pair of handles 40 for gripping. The handles may also extend between and connect to the head section 24 and the upper back section 36. Also, a plurality of pads 42 are attached to section 24 and neck support 28 to provide comfort for a user. In addition, the base 12 is curved downwardly toward a ground surface at the first end 18 and upwardly away from the bottom surface 16 at the second end 20.

In operation, an individual may perform a front plank placing their forearms on the upper back section 36 of the base and balancing over the arcuate support member 36. To perform a side plank, an individual places an arm on the back section 36 and balances over support member 26 or places an arm on the head section 24 which creates a stable slanted contact point for the arm.

To perform a reverse plank with full support, an individual positions their upper back on the upper back section 36 of base 12 and their head on the head section 24 such that their neck extends through open area 34 and is supported by neck support 38. The individual's heels contact the ground to engage the posterior musculature such that the individual must balance their weight over the apex of support member 26. Alternatively a reverse plank is performed by tilting end 20 toward the ground to create a slanted support that challenges the muscles of the upper and lower back to maintain stability. This approach avoids stressing the connective tissue of the shoulders.

Hamstring and buttock exercises may also be performed with the support 10. While supporting their back on the support 10, an individual raises into a hamstring curl position; back supported, knees bent, feet flat on the ground, and buttock raised in the air flexing the glut major/minor, hamstrings, and supporting posterior musculature. Typically when performing this movement the neck is placed in a very compromised, often painful position, as the body makes a 45 degree or greater angle with the ground. With the open area 34 falling into the concave "bowl", the head and neck are able to remain in line with the rest of the spine, so as to not compromise the safety and efficacy of the exercise. The convex support member 26 allows the device to "tip" as an individual raises into proper hamstring/glut positions, mimicking the angle the body makes to the ground. All of the posterior exercise on the upper back section 36 portion can be maximized by use of the grip ridge 28 located on the base 12 of support.

What is claimed is:

1. An exercise support, comprising:

a base having a top surface, a bottom surface, a first end, and a second end, wherein the base curves downwardly at the first end and upwardly at the second end;

a narrowed section of the base at the second end for providing head support;

a neck support directly connected to the top surface of the narrowed section;

a convex support member attached to the bottom surface of the base and having an apex; and a pair of ridges aligned and extending transversely across the top surface of the base and are separated by an open area.

2. The support of claim 1 wherein a pair of handles extend outwardly from the narrowed section.

3. The support of claim 1 wherein a layer of material is attached to at least a portion of the top surface of the base.

4. The support of claim 1 wherein the support member lays transversely across the bottom surface of the base closer to the first end than the second end.

5. The support of claim 1 wherein a flange extends away from the base at an outer perimeter for gripping.

6. The support of claim 1 wherein the ridges are positioned near a midpoint between the first and second ends.

7. The support of claim 1 wherein the ridges taper downwardly at ends near the open area.

8. An exercise support, comprising:

a base having a top surface, a bottom surface, a first end, and a second end;

a narrowed section of the base at the second end for providing head support;

a neck support directly connected to the top surface of the narrowed section;

a convex support member attached to the bottom surface of the base and having an apex; and a pair of ridges aligned and extending transversely across the top surface of the base and are separated by an open area;

wherein a plurality of pads are attached to the narrowed section.

9. An exercise support, comprising:

a base having a top surface, a bottom surface, a first end, and a second end;

a narrowed section of the base at the second end for providing head support;

a neck support directly connected to the top surface of the narrowed section;

a convex support member attached to the bottom surface of the base and having an apex; and a pair of ridges aligned and extending transversely across the top surface of the base and are separated by an open area;

wherein an apex of the neck support is lower than an apex of the pair of ridges.

10. The support of claim 9 wherein the neck support is perpendicular to the pair of ridges.

* * * * *